US006507955B1

(12) United States Patent
Fee et al.

(10) Patent No.: US 6,507,955 B1
(45) Date of Patent: Jan. 21, 2003

(54) ATHLETIC PROTECTIVE PAD

(75) Inventors: Terence Michael Fee, Clarendon Hills, IL (US); Robert Finley McDavid, III, Downers Grove, IL (US)

(73) Assignee: McDavid Knee Guard, Inc., Woodridge, IL (US)

( * ) Notice: Subject to any disclaimer, the term of this patent is extended or adjusted under 35 U.S.C. 154(b) by 0 days.

(21) Appl. No.: 09/927,092

(22) Filed: Aug. 9, 2001

(51) Int. Cl.[7] ..... A41D 13/00
(52) U.S. Cl. ..... 2/24
(58) Field of Search ..... 2/16, 24, 455, 2/22, 23, 62, 267, 904, 911, 458, 81; 156/235, 240, 247, 277, 289; 427/146, 147, 148; 428/195, 202, 42.1, 914; 430/126; 128/878, 881, 882, 892; 602/7, 8, 25, 26, 62, 63; 101/33, 34

(56) References Cited

U.S. PATENT DOCUMENTS

| | | | | |
|---|---|---|---|---|
| 1,081,245 A | | 12/1913 | McCall | |
| 2,446,654 A | | 8/1948 | Krcmar | |
| 2,552,177 A | | 5/1951 | Hurt | |
| 2,626,394 A | | 1/1953 | Davis | |
| 3,189,919 A | | 6/1965 | Chase | |
| 3,322,118 A | | 5/1967 | Sotherlin | |
| 3,322,873 A | | 5/1967 | Hitchcook | |
| 3,406,406 A | | 10/1968 | Lutz | |
| 3,463,147 A | | 8/1969 | Stubbs | |
| 4,084,584 A | | 4/1978 | Detty | |
| 4,107,365 A | * | 8/1978 | Reed et al. | 156/240 |
| 4,150,442 A | | 4/1979 | Boone | |
| 4,272,850 A | | 6/1981 | Rule | |
| 4,287,885 A | | 9/1981 | Applegate | |
| 4,474,573 A | | 10/1984 | Detty | |
| 4,484,361 A | | 11/1984 | Leighton et al. | |
| 4,494,247 A | | 1/1985 | Kelly | |
| 4,610,904 A | * | 9/1986 | Mahn et al. | 156/240 |
| 4,786,349 A | * | 11/1988 | Mahn, Sr. | 156/155 |

* cited by examiner

*Primary Examiner*—John J. Calvert
*Assistant Examiner*—Tejash Patel
(74) *Attorney, Agent, or Firm*—Fitch, Even, Tabin & Flannery

(57) ABSTRACT

A garment in the form of a knee pad or elbow pad protects a wearer during athletic activities. A toughening patch is applied to the outer surface of a nylon shell with the application of heat and pressure. A mixture of Teflon powder and plastisol ink is applied to a release liner and is applied to the nylon shell with the application of heat and pressure. Excess ink is removed from the patch with a blotting paper to impart a relatively low coefficient of friction to the patch.

3 Claims, 3 Drawing Sheets

ATHLETIC PROTECTIVE PAD

BACKGROUND OF THE INVENTION

1. Field of the Invention

The present invention pertains to protective pads worn in athletic events.

2. Description of Related Art

With increasing emphasis on sports and fitness there is a growing demand for athletic wear offering improved performance. For example, competitive indoor events such as volleyball are typically played on a hard wood floor. It is important, in executing some athletic maneuvers, that the participant be able to slide across the floor often times at great speed. It is important that vulnerable parts of the wearers anatomy, such as the knees and elbows be protected by pads or guards which do not impede the players performance. To this end, a number of lightweight protective pads, have been developed.

Such pads have been treated with a protective material where the pads contact the floor to protect the pad from the wear and tear caused by such sliding and to reduce friction, e.g., U.S. Pat. No. 4,494,247.

SUMMARY OF THE INVENTION

It is an object of the present invention to provide a protective pad for use in athletic events and to a method of making such a pad.

Another object of the present invention is to provide a pad to cover a wearers knee or elbow, reducing the risk of injury especially of a type which may be encountered when sliding across a floor.

A further object of the present invention is to provide a protective pad of improved economical construction which offer features which enhance a wearers athletic performance.

These and other objects of the present invention are provided in a protective garment for use on a wearer's knee or elbow to protect the wearer from injury in an athletic event, are comprised of a hollow cylindrical body including padding material covered by an outer nylon shell. A patch is applied to the outer surface of the nylon shell by heating and pressing a film of polytetrafluoroethylene (sold by the DuPont Corporation under the trademark TEFLON) powder and plastisol ink against an outer surface of the nylon shell.

DETAILED DESCRIPTION OF THE PREFERRED EMBODIMENTS

Figure 1:
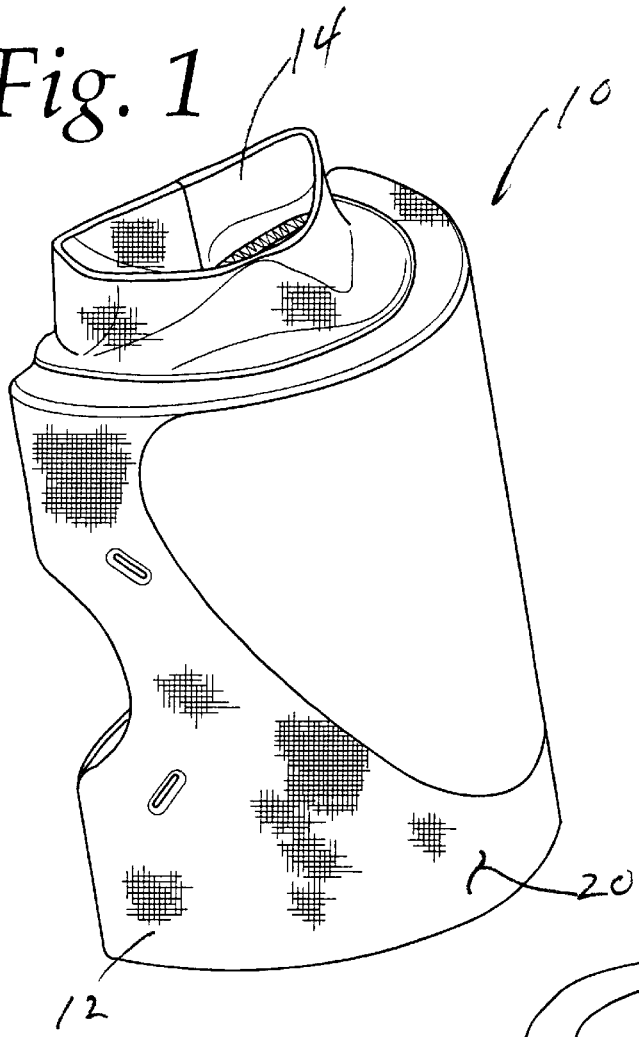
FIGS. 1 and 2 are perspective views of a protective garment according to the principles of the present invention.

Referring now to the drawings, a protective garment 10 provides protection to participants of indoor athletic events, especially competitive events such as volleyball and the like which are typically played on gymnasium floors of hard wood or other composition. In competitive volleyball matches and other athletic events a wearer frequently contacts the playing floor in maneuvers which include some form of sliding motion in which the participant experiences frictional engagement with the playing floor. Accordingly, a need has arisen for protective garments which are toughened to provide extended wear and to reduce premature failure caused, for example by melting when subjected to frictional heating. However, it is important that protective devices avoid hindering the participants playing ability if they are to receive substantial commercial acceptance. For example, it is important that knee pads and elbow pads employed for protection while sliding across a playing floor do not abruptly stop a player's motion. Accordingly, the contact surface portion of the protective garment must offer a sufficiently low frictional resistance while remaining tough enough to withstand the riggers of enthusiastic athletic activities.

Figure 2:
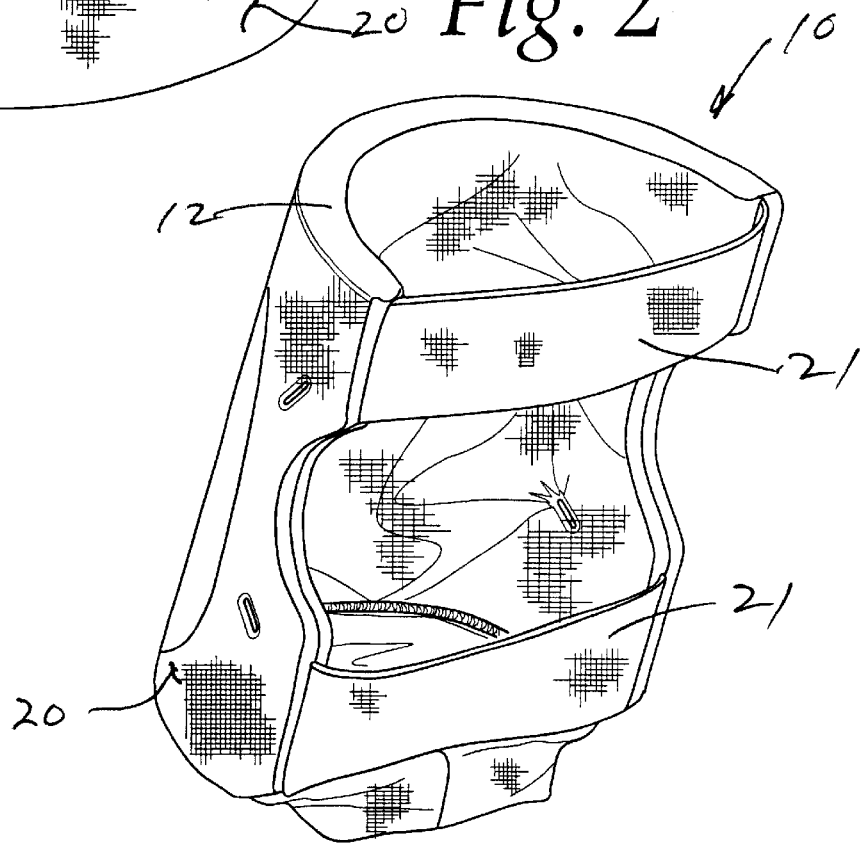

A protective garment 10 includes a body 12, preferably in the form of a cylinder, and a compressive cuff portion 14 disposed at one end, or optionally both ends. Cuff portion 14 is preferably made of elastic material of a type known in the art to maintain the position of garment 10 about a wearer's leg or arm, so as to locate protective device at the wearer's knee or elbow. The cylindrical body 12 is preferably provided with a conventional padding or cushioning material disposed within an outer shell 20, and fastening straps 21 (see FIG. 2).

Outer shell 20 is preferably comprised of nylon and most preferably comprised of 8 ounce nylon material, type 6—6 having the following percentage stretch characteristics: length (warp) of 45%, with a variance range between 30 and 65%. The stretch percentage of the material width (side or weft) is approximately 65% with a variance range between 45 and 85%. An example of such material is a type 6—6, 100% nylon, Product No. 1700 "Swiss Pique" commercially available from Adele Knits, Inc. of Winston-Salem, N.C.

Figure 3:
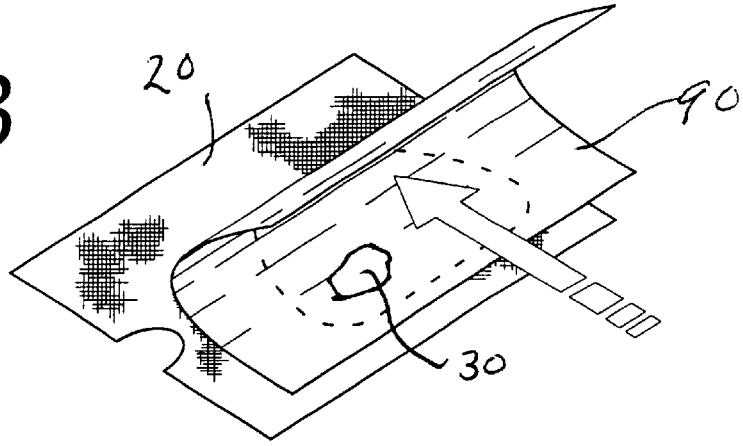
FIGS. 3–8 show assembly steps for fixing a patch according to principles of the present invention.

The patch 30 preferably comprises a solid film of polytetrafluoroethylene powders combined with plastisol inks to initially form a liquid coating. The coating is applied via a conventional silk screen process onto a paper release liner 90 (see FIG. 3), coated with a release agent such as silicone. Preferably, the coating mixture comprises hot split PVC plastisol ink with 25% by-volume additive polyamide of the polytetrafluoroethylene type. After application to the paper release liner, the coating is allowed to harden to form a solid film which is accumulated for subsequent delivery to a manufacturing site.

Figure 4:
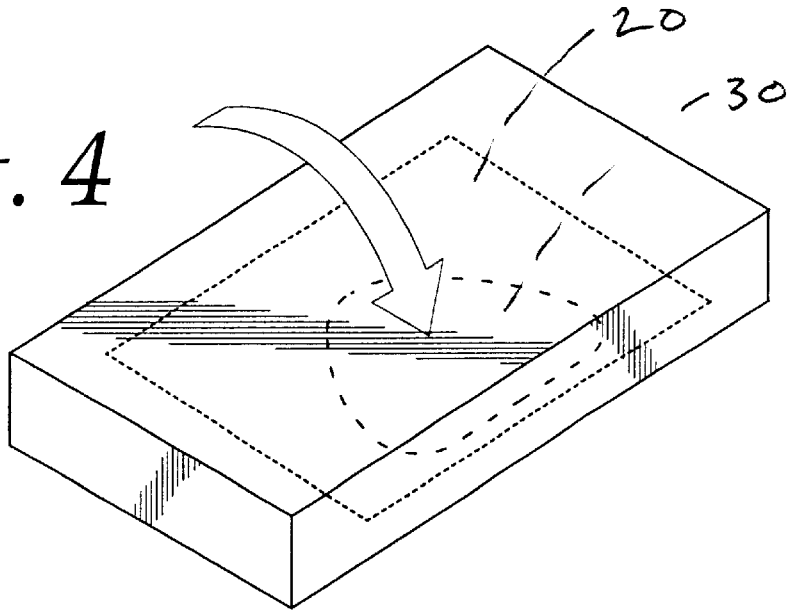

Upon arrival at the manufacturing site, the nylon shell 20 is prepared to receive the film coating. The transfer material, as mentioned, is provided in the form of a release liner, preferably a coated paper. The film coating is laid against the nylon shell (see FIG. 3) and heat is applied to the release liner. Optionally, heat may also be applied to the backside of the nylon shell. Simultaneous with the application of heat, pressure is applied to the release liner, pressing the heated coating against the nylon shell as schematically indicated in FIG. 4.

With the application of heat and pressure, the ink component of the film coating is dispersed into the fabric of the nylon shell while the polytetrafluoroethylene component of the film coating is bonded to the cloth fibers of the nylon shell. It is believed that there is substantial penetration of the polytetrafluoroethylene powders into the nylon fabric, in addition to a surface adhesion. Accordingly, any interposition of release agents or protective liners between the coating mixture and the nylon shell is avoided since this would retard or prohibit dispersion of the ink, as well as adhesion of the polytetrafluoroethylene powder component. The transfer operation of the preferred embodiment was carried out at a temperature of approximately 400° F., a pressure of approximately 80 lbs. and a dwell time of approximately 6 seconds, to achieve desired bonding, adhesion strength and color value. The ink component of the coating undergoes a substantial change of color value during the heat transfer process.

During application of the film coating the nylon shell undergoes substantial shrinking, that is, the surface area of the nylon material is noticeably reduced by the heat transfer process.

In order to produce a toughening patch using low cost fabrication techniques, it is preferred that the film coating mixture be compatible with conventional silk screen techniques. However, the amount of polytetrafluoroethylene material needed in an optimally efficient coating rendered the coating relatively thick or viscous. In order to prepare the coating for reliable silk screen printing using conventional techniques, an additional amount of ink was introduced into the mixture to act as a solvent or flowing medium, sufficient to allow the polytetrafluoroethylene component to flow or permeate through the silk screen in a conventional manner. In the preferred embodiment the amount of ink was in excess of an amount needed to adequately color the film coating. This excess amount of ink remains with the coating after the silk screen application to the paper release liner, and thereafter during the heat transfer process. It has been found preferable in order to achieve a reliable cost effective commercial process, that the excess ink remain in the composition and be transferred to the outer surface of the nylon shell 20.

Figure 5:
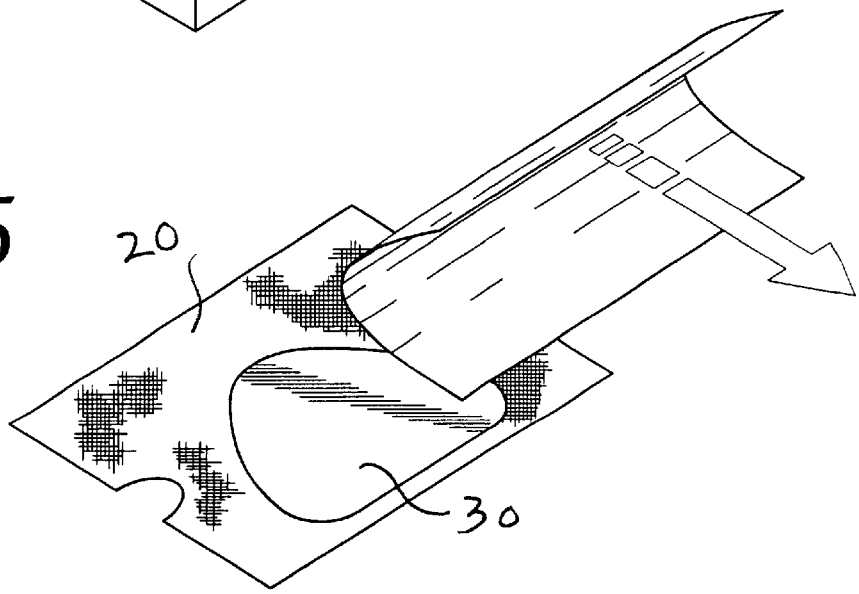
Figure 6:
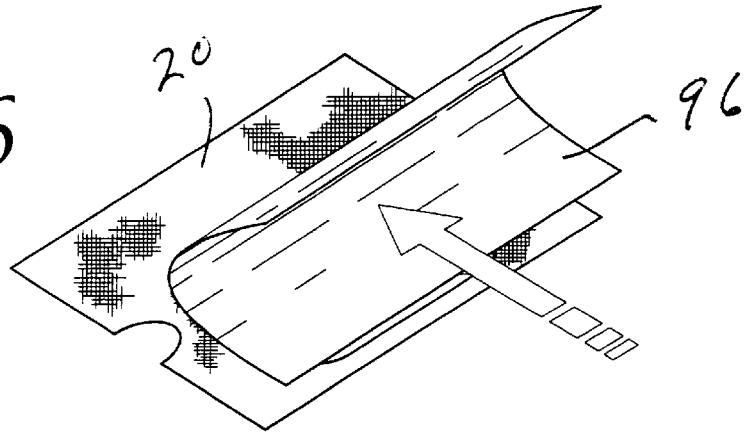
Figure 7:
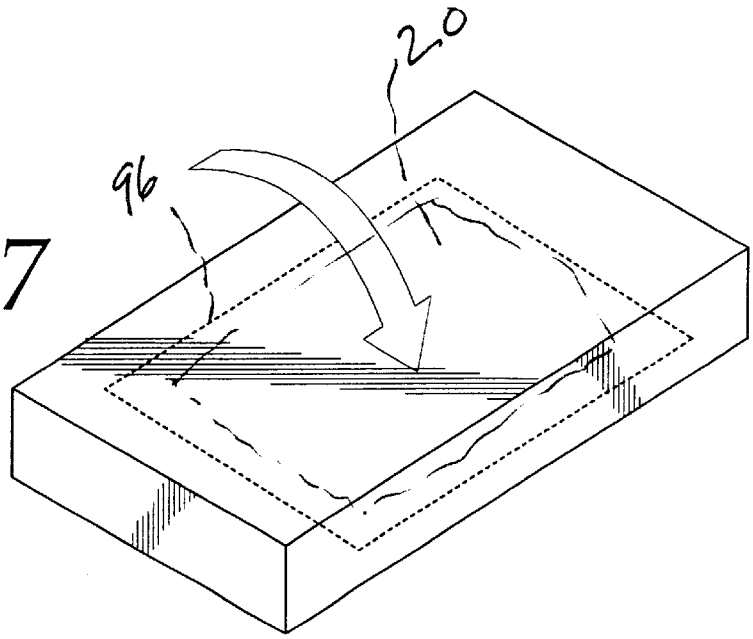
Figure 8:
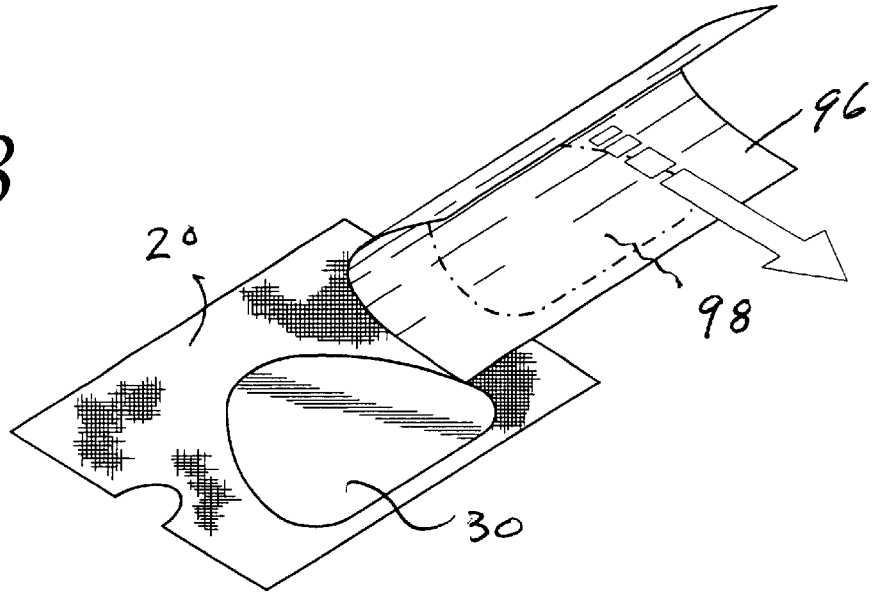

The excess ink raises the coefficient of friction of the applied coating to a level unacceptable for certain activities such as athletic competition. Accordingly, after the heat transfer is applied to the nylon shell and the liner 90 removed (see FIG. 5), one or more clean sheets of blotting or transfer paper 96 are pressed against the applied film of transfer material, preferably in the presence of heating, in order to fix a certain portion of the excess ink to the transfer paper (see FIGS. 6 and 7). In this manner, a certain portion of the excess ink 98 is extracted from the film coating as the paper 96 is removed (see FIG. 8). Depending upon the characteristics of the transfer paper used in the "blotting" operation two or more blotting operations are carried out subsequent to the initial heat transfer application. However, additional blotting operations may be unnecessary if a suitable paper having receptive characteristics is selected for the blotting operation. After the blotting operation, the applied coating is allowed to cool to form a rugged, low friction patch 30 which is aggressively bonded to the nylon shell so as to prevent edge separation or other defects.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A protective garment for use on a wearer's knee or elbow, comprising:

a padding material covered by an outer shell having an outer surface; and a patch of solidified ink and polytetrafluoroethylene powder mixture bonded to the outer surface of the shell.

2. The protective garment of claim 1 wherein the outer shell comprises a woven nylon material.

3. The protective garment of claim 2 wherein said outer shell has a lengthwise stretch of 45% with a variance range between 30 and 65% and a width wise stretch (side or weft) of approximately 65% with a variance range between 45 and 85%.

* * * * *